US005315315A

United States Patent [19]

Nakamura

[11] Patent Number: 5,315,315

[45] Date of Patent: May 24, 1994

[54] INTEGRATED CIRCUIT FOR DRIVING DISPLAY ELEMENT

[75] Inventor: Toshihiro Nakamura, Tenri, Japan

[73] Assignee: Sharp Kabushiki Kaisha, Osaka, Japan

[21] Appl. No.: 886,393

[22] Filed: May 21, 1992

[30] Foreign Application Priority Data

May 29, 1991 [JP] Japan ..... 3-126044

[51] Int. Cl.[5] ..... G09G 3/36

[52] U.S. Cl. ..... 345/208; 345/94; 345/76

[58] Field of Search ..... 340/784, 805, 783, 766, 340/781, 793; 358/236; 345/208, 94, 76

[56] References Cited

U.S. PATENT DOCUMENTS

| | | | |
|---|---|---|---|
| 4,554,539 | 11/1985 | Graves | 340/805 |
| 4,795,239 | 1/1989 | Yamashita | 340/784 CL |
| 4,930,875 | 6/1990 | Inoue | 340/805 |
| 4,962,376 | 10/1990 | Inoue | 340/805 |
| 4,983,956 | 1/1991 | Salam | 340/783 |
| 5,018,841 | 5/1991 | Mouri | 340/805 |
| 5,136,408 | 8/1992 | Okada | 340/805 |

FOREIGN PATENT DOCUMENTS

| | | | |
|---|---|---|---|
| 62-235930 | 10/1987 | Japan . | |
| 0126628 | 5/1989 | Japan | 340/784 CL |

OTHER PUBLICATIONS

"Full-Line Scanned LCD-TV by Non-Integrated Driving Method" by Takeo Nomura et al, Sharp Tech. Journal. No. 44, pp. 51-54, 1990, Japan.

*Primary Examiner*—Alvin E. Oberley
*Assistant Examiner*—Minsun Oh

[57] ABSTRACT

An integrated circuit for driving a plurality of scanning electrodes of a display element of matrix type, includes: a driving pulse generating device provided with a plurality of output terminals, each of which is connected to each scanning electrode of the display element, for outputting a driving pulse sequentially from each of the output terminals on the basis of a predetermined clock signal, so as to scan all of the display surface of the display element in one operation period; and a control device for giving a control signal to the driving pulse generating device so as to direct the driving pulse generating device to generate a plurality of driving pulses during one operation period successively per each of the output terminals.

17 Claims, 6 Drawing Sheets

INTEGRATED CIRCUIT FOR DRIVING DISPLAY ELEMENT

BACKGROUND OF THE INVENTION

1. Field of the Invention

The present invention relates to an integrated circuit for driving scanning electrodes of a display element of matrix type, such as a LCD (Liquid Crystal Display) element of active matrix type, an EL (Electroluminescence) display element and so on.

2. Description of the Related Arts

Such a display element, which is driven by this kind of driving integrated circuit, can be utilized in a liquid crystal television and other various kinds of display devices.

In the control device of the conventional art, a clock signal of a predetermined cycle is generated and a pulse signal is also generated such that the pulse signal is a high level during one cycle of the clock signal. In this driving integrated circuit, the pulse signal is taken in at the pulse rise timing of the clock signal and is held to become a control signal.

This driving integrated circuit also includes a shift register which takes in the control signal as a serial signal, by use of the clock signal as a shift clock, so as to output a parallel signal. Then, each outputted parallel signal from the shift register is gated with an inverted signal of the clock signal, by use of a NAND gate. Then, the level of thus gated signal is corrected, and thus level-corrected signal is outputted as a driving pulse from the output terminals of the driving integrated circuit.

In this manner, when the control signal is once taken in by the shift register, it is synchronized with the shift clock and is moved across the shift register, so that the driving pulse is correspondingly outputted from each output terminal.

On the other hand, the liquid crystal display element, which is to be driven by this type of driving integrated circuit, is equipped with a plurality of scanning electrodes. Each scanning electrode is sequentially driven by giving the driving pulse from each corresponding output terminal of the driving integrated circuit, such that one whole display surface of the liquid crystal display element is scanned by the scanning electrodes in one operation period, and one display image is formed on the display surface according to the image signal supplied to the signal electrodes arranged in the liquid crystal display element. By repeating this image forming process sequentially, the moving picture can be formed on the liquid crystal display element, so that the liquid crystal television can be realized.

When the liquid crystal panel including the TFT (Thin Film Transistor) is to be driven at a high speed, in order to prevent the degradation of the contrast, it becomes necessary to select and drive each scanning electrode twice or more than twice successively during above-mentioned one operation period.

However, in case of the above explained driving integrated circuit, only one driving pulse can be outputted from one output terminal during one operation period. Accordingly, in order to select and drive one scanning electrode successively twice in one operation period for example, it becomes necessary to have two driving integrated circuits, for outputting two driving pulses with respect to one scanning electrode in one operation period, which timings are different from each other, and to use thus outputted driving pulses in a parallel manner.

However, it is very difficult in a practical sense to install two or more the driving integrated circuits to one liquid crystal display element and to establish such a circuit arrangement and electrical connections to supply the driving signals in the above mentioned parallel manner.

SUMMARY OF THE INVENTION

It is therefore an object of the present invention to provide an integrated circuit for driving a display element of matrix type, which can be easily installed to the display element, and which can select and drive one scanning electrode successively twice in one operation period.

According to the present invention, the above mentioned object can be achieved by an integrated circuit for driving a plurality of scanning electrodes of a display element of matrix type. The integrated circuit includes: a driving pulse generating device provided with a plurality of output terminals, each of which is connected to each scanning electrode of the display element, for outputting a driving pulse sequentially from each of the output terminals on the basis of a predetermined clock signal, so as to scan all of the display surface of the display element in one operation period; and a control device for giving a control signal to the driving pulse generating device so as to direct the driving pulse generating device to generate a plurality of driving pulses during one operation period successively per each of the output terminals.

In the operation of the integrated circuit of the present invention, the output terminals of the driving pulse generating device are connected with the scanning electrodes of the display element, respectively. The control device gives the control signal to the driving pulse generating device so as to direct the driving pulse generating device to generate a plurality of driving pulses during one operation period successively per each of the output terminals. Then, the driving pulse generating device outputs two or more successive driving pulses sequentially from each of the output terminals on the basis of the predetermined clock signal. Accordingly, during one operation period, each of the scanning electrodes can be selected and driven by a plurality of times, so as to avoid the degradation of the contrast of the display image due to the high speed driving operation, just by use of only one driving integrated circuit. At this time, the output terminals can be constructed in the same manner, about its shape, number, etc., as in the case of the aforementioned related arts, so as to enable a relatively easy installation to the display element by use of the same installation technique of the related art cases. Consequently, a high grade moving picture can be realized with a relatively low cost according to the present invention. For example, a liquid crystal display panel including TFT can be driven by the present invention at a high speed, while the degradation due to the high speed driving operation, of the image displayed on the liquid crystal display panel, can be avoided quite effectively, by use of a relatively simple construction.

Further objects and advantages of the present invention will be apparent from the following description of the preferred embodiment of the invention as illustrated in the accompanying drawings.

DETAILED DESCRIPTION OF THE PREFERRED EMBODIMENT

A preferred embodiment of the present invention will be described below with reference to the accompanying drawings.

Figure 1:
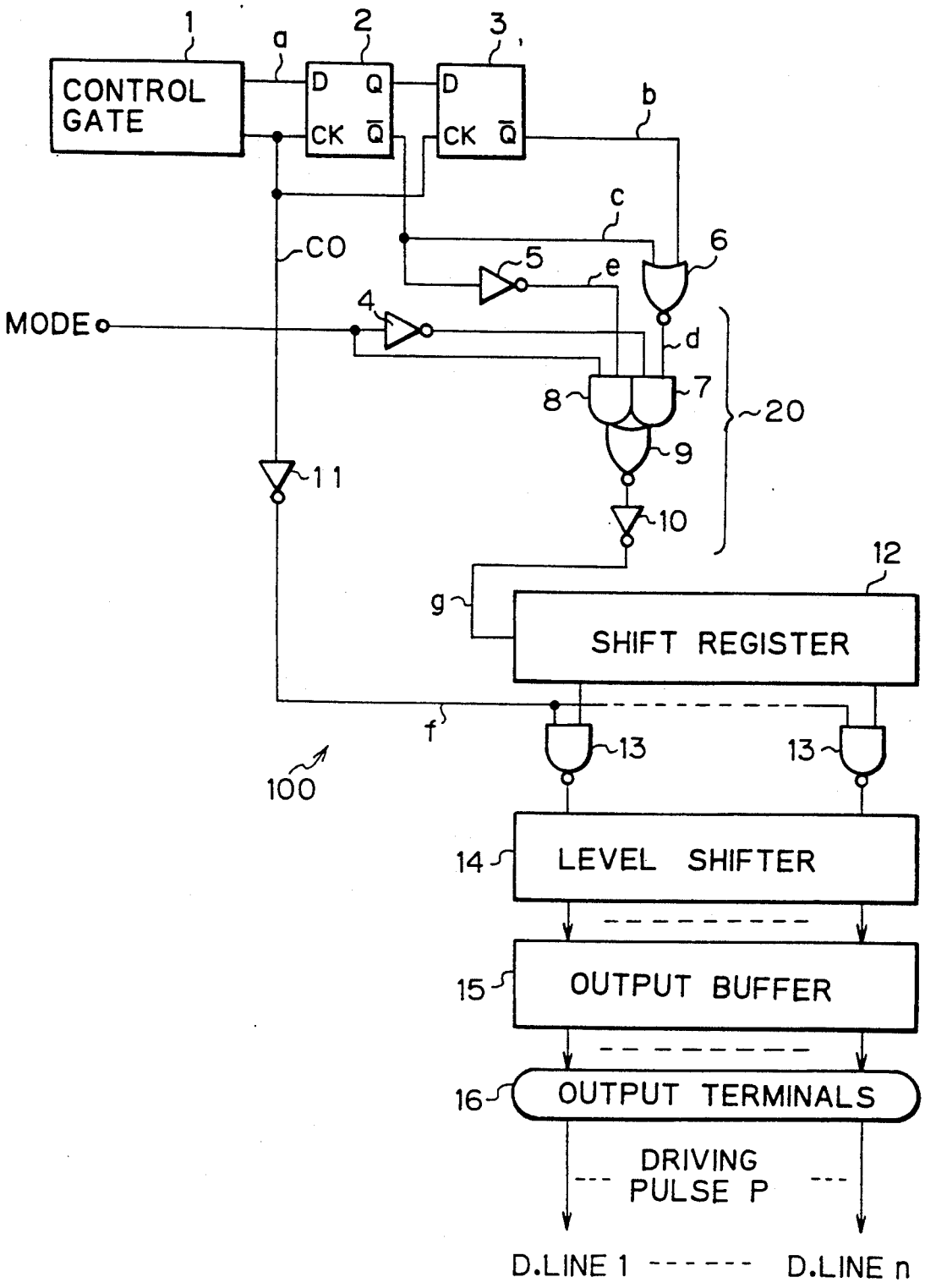
FIG. 1 is a summarized circuit diagram of an integrated circuit for driving a liquid crystal display element, as an embodiment of the present invention.

In FIG. 1, the reference number 100 designates an integrated circuit for driving a liquid crystal display element.

The integrated circuit 100 is provided with a control gate 1, a D flip-flop 2, a D flip-flop 3, inverting circuits 4 and 5, a NOR circuit 6, AND circuits 7 and 8, a NOR circuit 9, and inverting circuits 10 and 11.

Figure 2:
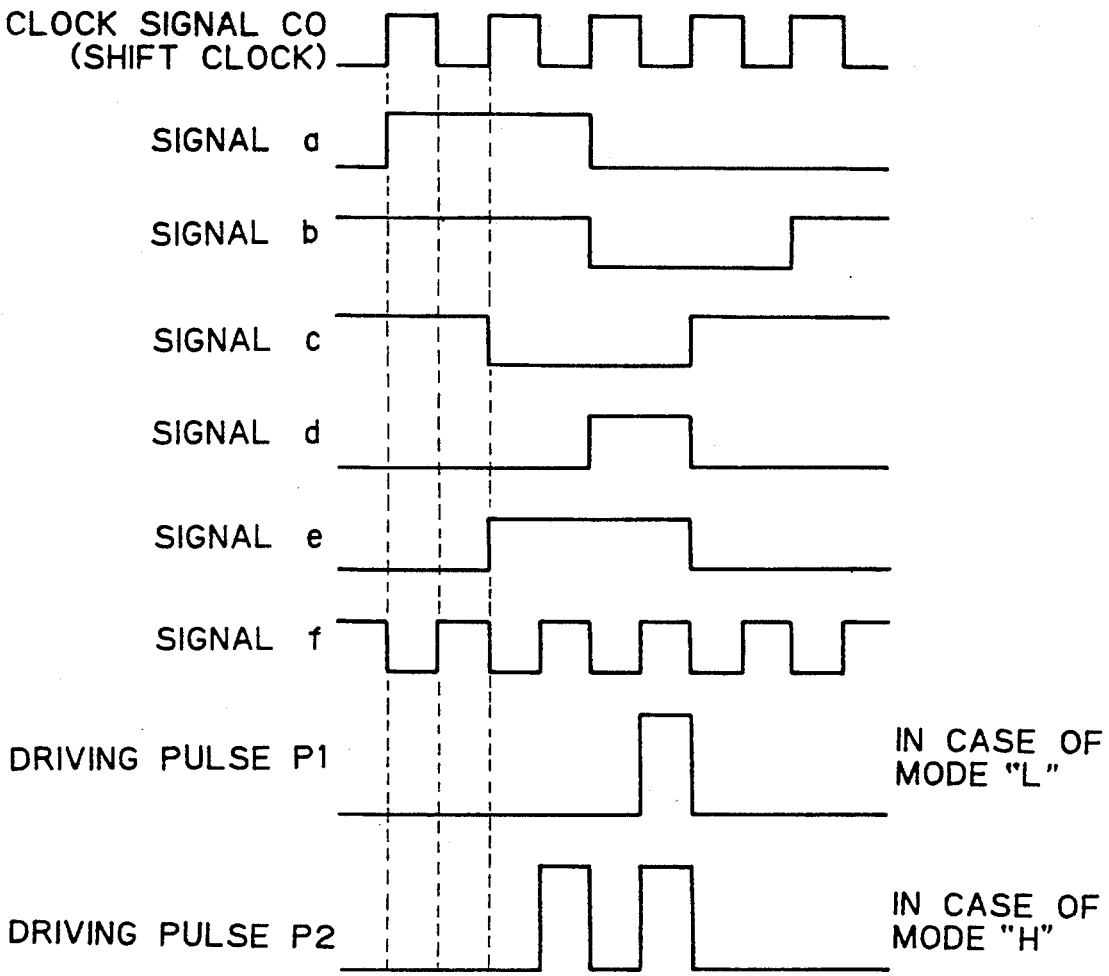
FIG. 2 is a timing chart showing various signal in each component of the integrated circuit of FIG. 1.

A control gate 1 generates a clock signal CO of a predetermined cycle and a signal a, which is a high level during the period corresponding to two cycles of the clock signal CO, as shown in FIG. 2. The D flip-flop 2 takes in this signal a from the control gate 1, at the pulse rising timing of the clock signal CO and holds the signal. The D flip-flop 3 further takes in the output signal of the D flip-flop 2 at the pulse rise timing of the clock signal CO, and inverts it to output a signal b. The NOR circuit 6 takes the logical sum of the signal c, which is inverted by and outputted from the D flip-flop 2, and the signal b, which is outputted from the D flip-flop 3, and inverts the resultant logical sum, so as to outputs the signal d as a result. On the other hand, the inverting circuit 5 inverts the signal c from the D flip-flop 2, and output the result as a signal e.

The inverting circuit 4, the AND circuits 7 and 8, the NOR circuit 9 and the inverting circuit 10 construct a selector circuit 20. Namely, on one hand, when the mode selecting signal MODE is at the high level, the signal e is outputted from the inverting circuit 10 as a control signal g. On the other hand, when the mode selecting signal MODE is at the low level, the signal d is outputted from the inverting circuit 10 as a control signal g.

The integrated circuit 100 is also provided with a shift register 12, which receives the control signal g and generates a driving pulse p, a plurality of NAND circuits 13, a level shifter 14, an output buffer 15, and a plurality of output terminals 16.

The shift register 12 receives the control signal g, which may be the signal e or the signal d, from the inverting circuit 10, as a serial signal, i.e. takes in the control signal g by use of the clock signal CO as a shift clock, and holds the taken in signals, such that the taken in signals are shifted one after another in the shift register 12 in synchronization with the shift clock. The shift register 12 changes received signals in the form of serial signal to the signals in the form of parallel signal and output the parallel signal. The NAND circuit 13 receives each signal composing this parallel signal from the shift register 12, and applies the gate process to the received signal with the signal f, which is generated by inverting the clock signal CO by the inverting circuit 11.

The level shifter 14 changes the level of each outputted signal of the NAND circuits 13, to the appropriate level for driving the scanning electrodes of the liquid crystal display element to be connected. The output buffer 15 outputs the signals processed by the level shifter 14, as driving pulses p via output terminals 16.

The operation of thus constructed integrated circuit 100 is explained hereinbelow.

Figure 3:
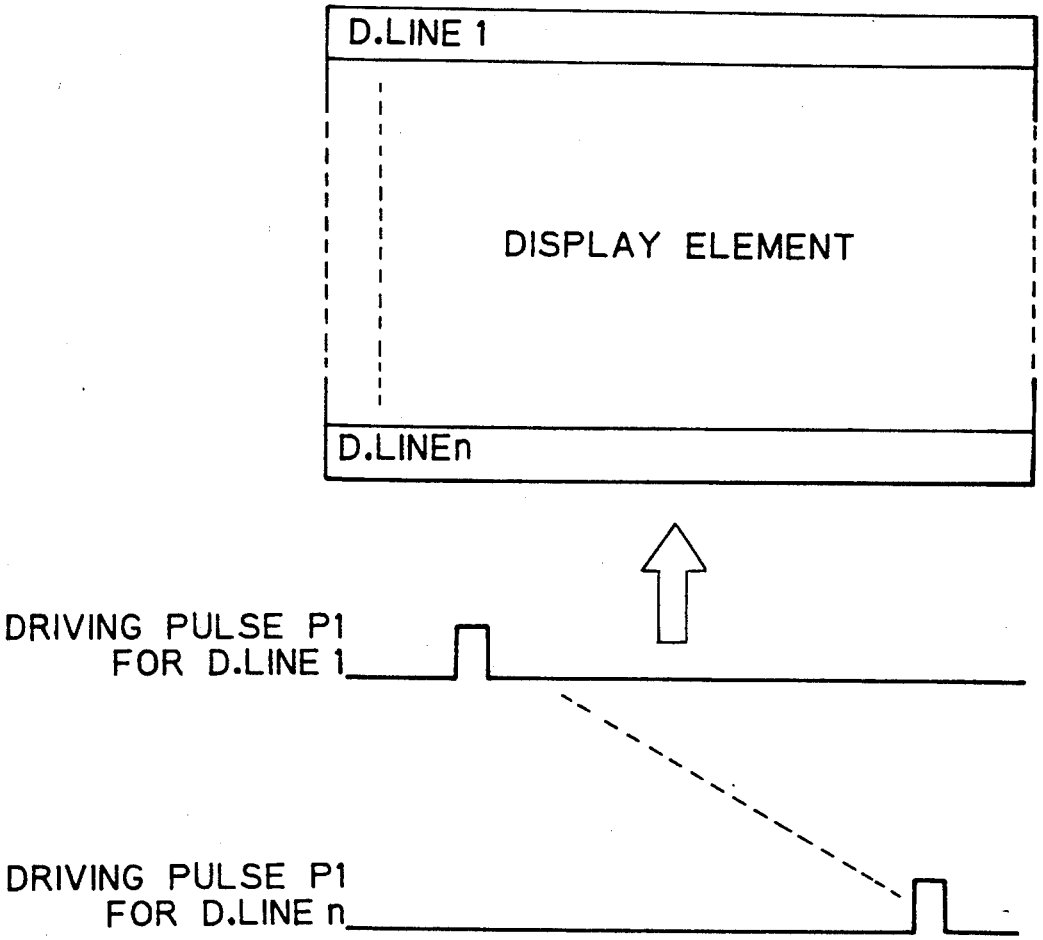
FIG. 3 is an explanation view showing driving pulses supplied to each scanning electrodes of a liquid crystal display element from the integrated circuit of FIG. 1 in one condition.

When the mode selecting signal MODE is a low level, just one driving pulse p is outputted at once from each of the output terminal 16 as shown in FIG. 3, as following. Namely, in this case, since the output of the inverting circuit 4 is turned to be the high level, the signal d, which is turned to be the high level during the period corresponding to just one cycle of the clock signal CO, is selected by the selector circuit 20 as the control signal g, and is then inputted to the shift register 12 as the serial signal.

Then, the shift register 12 takes in this control signal g, and moves it each time when the shift clock is inputted, so that it outputs the parallel signal from each output terminal one after another. At this time, since the parallel signal outputted from the shift register 12, is gated with the signal f, which is generated by inverting the clock signal CO, by the NAND circuits 13, the parallel signal becomes such a pulse as is a high level during only the period when the signal f is a high level.

The level shifter 14, changes the level of each outputted signal of the NAND circuits 13 to the level enough to drive each scanning electrode of the liquid crystal display element. Then, the output buffer 15 outputs each level shifted pulse as the driving pulse P1 as shown in FIGS. 2 and 3, via each output terminal 16 to the scanning electrodes D.LINE1 to D.LINEn.

Figure 4:
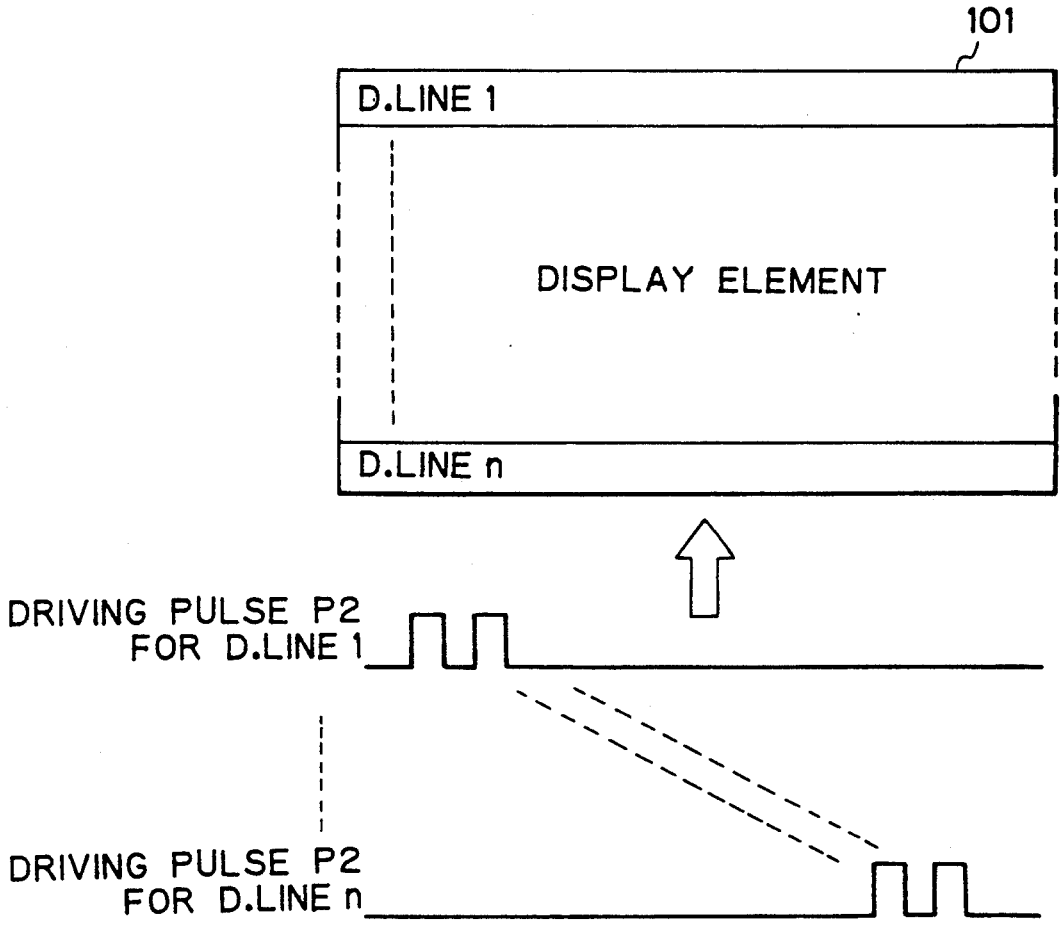
FIG. 4 is an explanation view showing driving pulses supplied to each scanning electrodes of a liquid crystal display element from the integrated circuit of FIG. 1 in another condition.

On the other hand, when the mode selecting signal MODE is a high level, two successive driving pulses are outputted at once, as shown in FIG. 4, as following. Namely, in this case, since the high level mode signal MODE is supplied to the AND circuit 8, the signal e, which is a high level during the period corresponding to two cycles of the clock signal CO, is selected by the selector circuit 20, as the control signal g, and is inputted to the shift register 12. The shift register 12 takes in this control signal g, and shifts it per each clock signal CO. Here, since the pulse width of the control signal g in this case corresponds to the two cycles of the clock signal CO, the high level signal is outputted from the output terminal of the parallel signal during the period corresponding to the two cycles of the clock signal CO. Accordingly, each NAND circuit 13, outputs two pulses successively, so that the driving pulse P2 as shown in FIGS. 2 and 4, is outputted from each of the output terminals 16.

Figure 5:
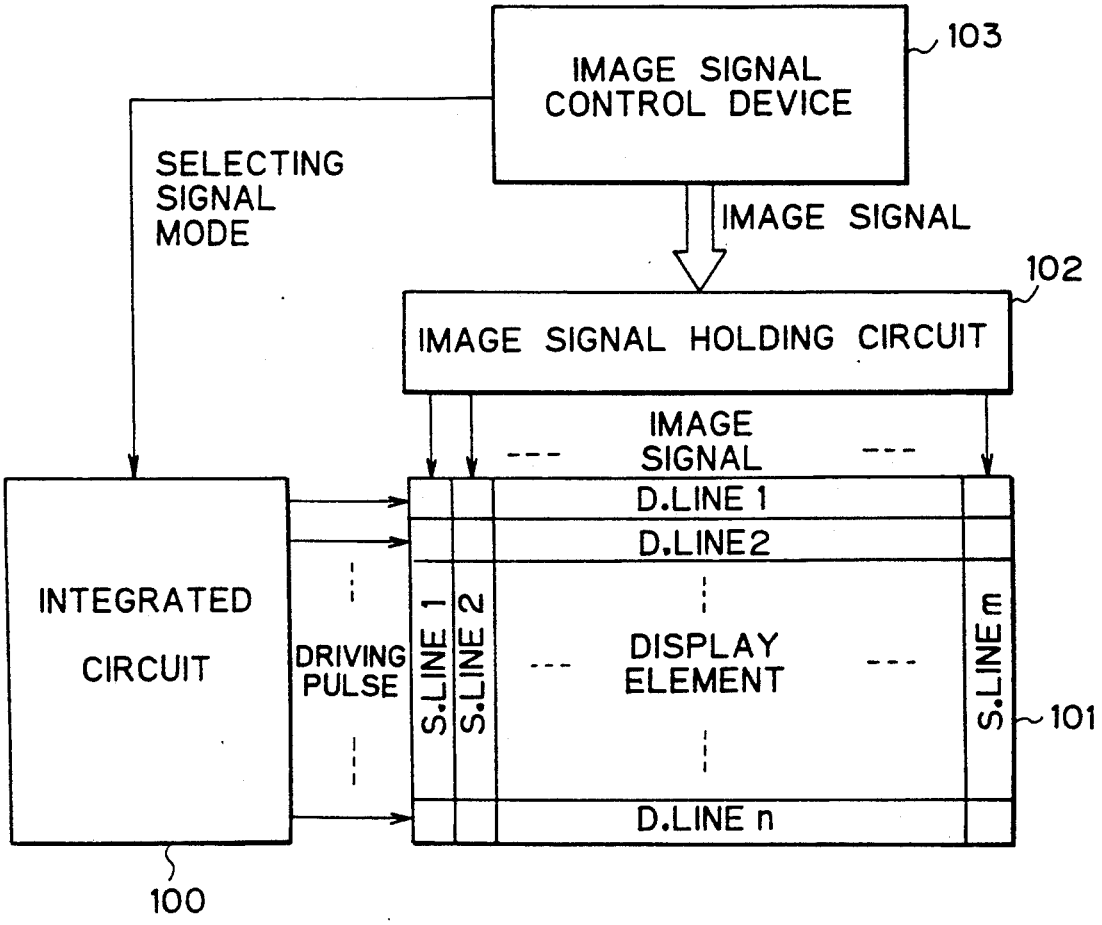
FIG. 5 is a block diagram of a liquid crystal display device equipped with the integrated circuit of FIG. 1 connected with a liquid crystal display element.

FIG. 5, shows a liquid crystal display device, in which the above explained integrated circuit 100 is installed to the liquid crystal display element.

In FIG. 5, the reference number 101 designates an liquid crystal display element 101.

The liquid crystal display element 101 is provided with a plurality of scanning electrodes D.LINE1 to D.LINEn, each of which is connected with each of the output terminals of the integrated circuit 100, and a plurality of signal electrodes S.LINE 1 to S.LINEm, each of which is connected with each of the output terminals of an image signal holding circuit 102, so as to function as a liquid crystal display element of active matrix type.

The image signal holding circuit 102 is adapted to hold the image signals from an image signal control device 103 in the form corresponding to each of the signal electrodes S.LINE1 to S.LINEm, and output them at a prescribed timing to the signal electrodes S.LINE1 to S.LINEm. On the other hand, the image signal control device 103 gives the mode selecting signal MODE to the integrated circuit 100, and directs which signal d or signal e should be selected at the selector circuit 20 as the control signal g.

FIG. 4 shows how the liquid crystal display element 101 is driven by the integrated circuit 100.

As shown in FIG. 4, two successive pulses are sequentially given from each output terminal of the integrated circuit 100 to each of the scanning electrodes D.LINE1 to D.LINEn correspondingly of the liquid crystal display element 101. Thus, each of the scanning electrodes D.LINE1 to D.LINEn can be selected and driven twice at once in one operation period.

Figure 6:
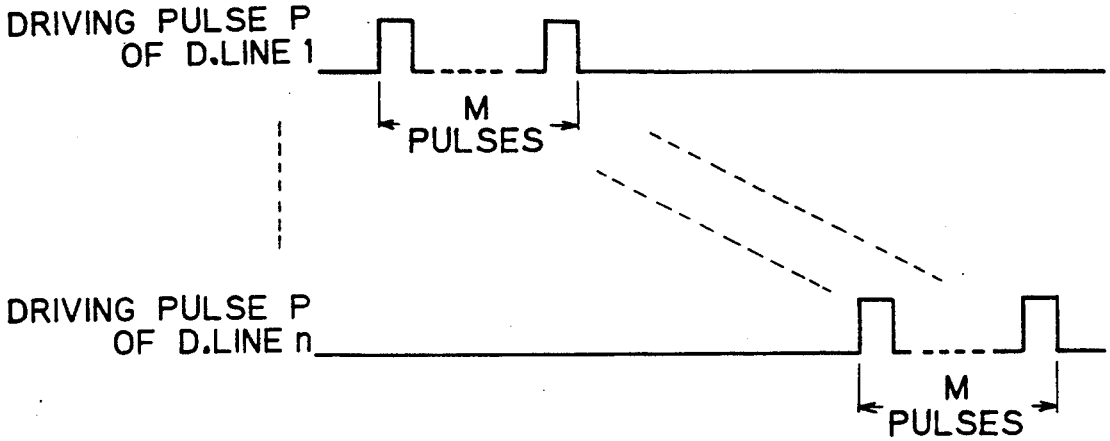
FIG. 6 is an explanation view showing driving pulses supplied to each scanning electrodes of a liquid crystal display element from another embodiment of the present invention.

In the above described embodiment, the two successive driving pulses are outputted at once from each of the output terminals 16. The number of the successive driving pulses may be increased to be more than two, as shown in FIG. 6, by changing the pulse width of the signal e to be supplied as the control signal g to the shift register 12.

Figure 7:
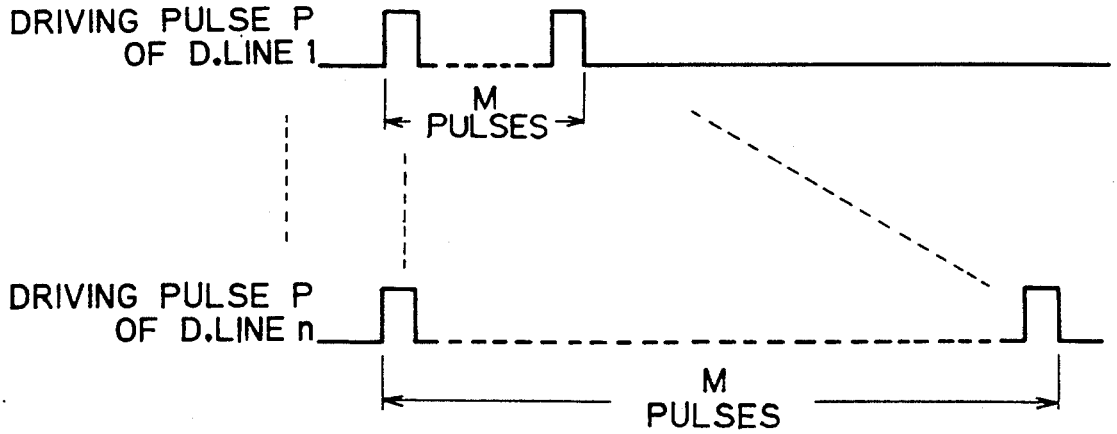
FIG. 7 is an explanation view showing driving pulses supplied to each scanning electrodes of a liquid crystal display element from another embodiment of the present invention.

Further, the time duration between the two successive driving pulses may be varied with respect to each of the scanning electrodes, as shown in FIG. 7, by changing the pulse width of the signal e, which is supplied as the control signal g to the shift register 12 and changing the cycle of the signal f, which is supplied to the NAND circuit 13, with respect to each of the scanning electrodes.

As described in detail above, according to the present embodiment, since the selector circuit 20 gives the control signal g to the shift register 12, the shift register 12 and the NAND circuits 13 generate two or more successive driving pulses sequentially from each of the output terminals 16 on the basis of the predetermined clock signal CO. Accordingly, during one operation period, each of the scanning electrodes of the liquid crystal display element 101 can be selected and driven by a plurality of times, so as to avoid the degradation of the contrast of the display image of the liquid crystal display element 101 due to the high speed driving operation.

The installation of the integrated circuit 100 to the liquid crystal display element 101 is rather easily performed by use of the same installation technique of the related art cases. Consequently, a high grade moving picture can be realized with a relatively low cost by use of the integrated circuit 100.

Many widely different embodiments of the present invention may be constructed without departing from the spirit and scope of the present invention. It should be understood that the present invention is not limited to the specific embodiments described in this specification, except as defined in the appended claims.

What is claimed is:

1. An integrated circuit for driving a plurality of scanning electrodes of a display element of matrix type, comprising:

driving pulse generating means, provided with a plurality of output terminals, each output terminal being connected to each scanning electrode of the display element, for outputting at least one driving pulse sequentially from each output terminal in response to a clock signal, so as to scan an entire display surface of the display element in one operation period; and control means for controlling said driving pulse generating means to generate a plurality of driving pulses, having a same polarity during said one operation period, successively from each output terminal to prevent degradation of the control of the display element, said control means comprising a control gate for generating a clock signal and a control signal which is at a high level during the period corresponding to plural cycles of said clock signal and serves to determine the number of the plural driving pulses which are to be generated during said one operational period, successively from each output terminal, and a selector circuit for selecting either a first mode of the integrated circuit, in which said driving pulse generating means generates one driving pulse during one operational period for each output terminal, or a second mode of the integrated circuit, in which said driving pulse generating means generates a plurality of driving pulses successively during said one operation period for each output terminal.

2. The integrated circuit according to claim 1, wherein said driving pulse generating means is controlled to output two successive driving pulses from each output terminal by said control means.

3. The integrated circuit according to claim 1, wherein said driving pulse generating means is controlled to output more than two successive driving pulses from each output terminal by said control means.

4. The integrated circuit according to claim 1, wherein said control gate generates the control signal with a high level during the period corresponding to two cycles of said clock signal.

5. The integrated circuit according to claim 1, wherein said control means further comprises:

a pulse generator for receiving said clock signal and said control signal from said control gate and supplying a first signal having the same duration as said control signal and a second signal with a high level corresponding to one cycle of said clock signal to said selector circuit.

6. The integrated circuit according to claim 5, wherein said selector circuit comprises:

two AND circuits, one AND circuit receiving the first signal from said pulse generator and a mode selecting signal, the other AND circuit receiving the second signal from said pulse generator and the inverted signal of the mode selecting signal;

a NOR circuit whose inputs are connected to the outputs of said AND circuits; and an inverting circuit whose input is connected to the output of said NOR circuit.

7. The integrated circuit according to claim 5, wherein said pulse generator comprises:

a first flip-flop circuit connected to said control gate for receiving said clock signal and said control signal;

a second flip-flop circuit connected to said control gate and said first flip-flop circuit for receiving said clock signal and an output signal of said first flip-flop;

an inverting circuit for receiving the inverted signal of the output signal of said first flip-flop and outputting the first signal having the same duration as said control signal; and a NOR circuit for receiving the inverted signal of the output signal of said first flip-flop and an output signal of said second flip-flop and outputting the second signal.

8. The integrated circuit according to claim 1, wherein said driving pulse generating means comprises:

a shift register connected to said control means for changing received serial signals to parallel signals;

a plurality of NAND circuits responsive to the clock signal, one input of each NAND circuit being connected to said shift register;

a level shifter connected to outputs of said NAND circuits for changing a level of each output signal of each NAND circuit; and an output buffer connected to outputs of said level shifter and said output terminals for outputting said driving pulses.

9. An integrated circuit for driving a plurality of scanning electrodes of a display element of matrix type, comprising:

driving pulse generating means provided with a plurality of output terminals, each output terminal being connected to each scanning electrode of the display element, for outputting at least one driving pulse sequentially from each output terminal in response to a predetermined clock signal, so as to scan an entire display surface of the display element in one operational period; and control means for controlling said driving pulse generating means to generate a plurality of driving pulses during one operational period successively for each output terminal;

said control means including a selector circuit for selecting either a first mode in which said driving pulse generating means generates one driving pulse during one operational period for each output terminal, or a second mode in which said driving pulse generating means generates a plurality of driving pulses successively during one operational period of each output terminal.

10. The integrated circuit according to claim 9, wherein said driving pulse generating means is controlled to output two successive driving pulses from each output terminal by said control means.

11. The integrated circuit according to claim 9, wherein said driving pulse generating means is controlled to output more than two successive driving pulses from each output terminal by said control means.

12. The integrated circuit according to claim 9, wherein said control means comprises:

a control gate for generating a clock signal and a control signal which is a high level during the period corresponding to plural cycles of said clock signal and serves to determine the number of the plural driving pulses which are to be generated during one operational period successively for each output terminal.

13. The integrated circuit according to claim 12, wherein said control gate generates the control signal with a high level during the period corresponding to two cycles of said clock signal.

14. The integrated circuit according to claim 12, wherein said control means further comprises:

a pulse generator for receiving said clock signal and said control signal from said control gate and supplying a first signal having the same duration as said control signal and a second signal with the high level corresponding to one cycle of said clock signal to said selector circuit.

15. The integrated circuit according to claim 14, wherein said selector circuit comprises:

two AND circuits, one AND circuit receiving the first signal from said pulse generator and a mode selecting signal, the other AND circuit receiving the second signal from said pulse generator and the inverted signal of the mode selecting signal;

a NOR circuit whose inputs are connected to the outputs of said AND circuits; and an inverting circuit whose input is connected to the output of said NOR circuit.

16. An integrated circuit according to claim 14, wherein said pulse generator comprises:

a first flip-flop circuit connected to said control gate for receiving said clock signal and said control signal;

a second flip-flop circuit connected to said control gate and said first flip-flop circuit for receiving said clock signal and an output signal of said first flip-flop;

an inverting circuit for receiving the inverted signal of the output signal of said first flip-flop and outputting the first signal having the same duration as said control signal; and a NOR circuit for receiving the inverted signal of the output signal of said first flip-flop and an output signal of said second flip-flop and outputting the second signal.

17. The integrated circuit according to claim 9, wherein said driving pulse generating means comprises:

a shift register connected to said control means for changing received serial signals to parallel signals;

a plurality of NAND circuits responsive to the clock signal, one input of each NAND circuit being connected to said shift register;

a level shifter connected to outputs of said NAND circuits for changing a level of each output signal of each NAND circuit; and an output buffer connected to outputs of said level shifter and said output terminals for outputting said driving pulses.

* * * * *